United States Patent [19]

Hixson

[11] Patent Number: 5,003,940

[45] Date of Patent: Apr. 2, 1991

[54] QUICK ADJUST TAPPET ASSEMBLY

[76] Inventor: William J. Hixson, 4220 NE. 90th, Seattle, Wash. 98115

[21] Appl. No.: 557,875

[22] Filed: Jul. 25, 1990

[51] Int. Cl.[5] ..... F01L 1/14; F01L 1/20

[52] U.S. Cl. ..... 123/90.54; 123/90.52

[58] Field of Search ..... 123/90.48, 90.5, 90.52, 123/90.54

[56] References Cited

U.S. PATENT DOCUMENTS

| | | | |
|---|---|---|---|
| 1,496,497 | 6/1924 | Swarthout et al. . | |
| 3,002,508 | 10/1961 | Barker et al. . | |
| 3,002,509 | 10/1961 | Fitzgerald et al. | 123/90.52 |
| 3,120,221 | 2/1964 | Lyons | 123/90.52 |
| 3,301,239 | 1/1967 | Thauer . | |
| 3,413,964 | 12/1968 | Pask . | |
| 3,675,631 | 7/1972 | Hixson . | |
| 3,823,698 | 7/1974 | Van Deberg | 123/90.54 |
| 3,941,102 | 3/1976 | Bareham | 123/90.52 |
| 4,321,894 | 3/1982 | Black | 123/90.54 |
| 4,469,057 | 9/1984 | Black | 123/90.54 |

*Primary Examiner*—David A. Okonsky
*Assistant Examiner*—Weilun Lo
*Attorney, Agent, or Firm*—Ward Brown; Robert W. Beach

[57] ABSTRACT

An inverted cup follower is fitted in a bore of the cylinder head of an internal combustion engine in line with the upright stem of an intake or exhaust valve. Such follower has a threaded central bore receiving a complementally threaded plug. The plug has a rectangular socket receiving the rectangular tongue of a cap member which is turnable so as to advance the plug toward or away from the valve stem and thereby adjust the valve clearance. To maintain a desired adjustment, a spring-loaded locking pin normally is received in any one of several closely spaced peripheral notches of the cap member so as to prevent rotation of the cap member relative to the inverted cup follower. The pin can be moved to an unlocked position to permit rotating adjustment of the cap member and the central plug.

10 Claims, 3 Drawing Sheets

Fig. 1
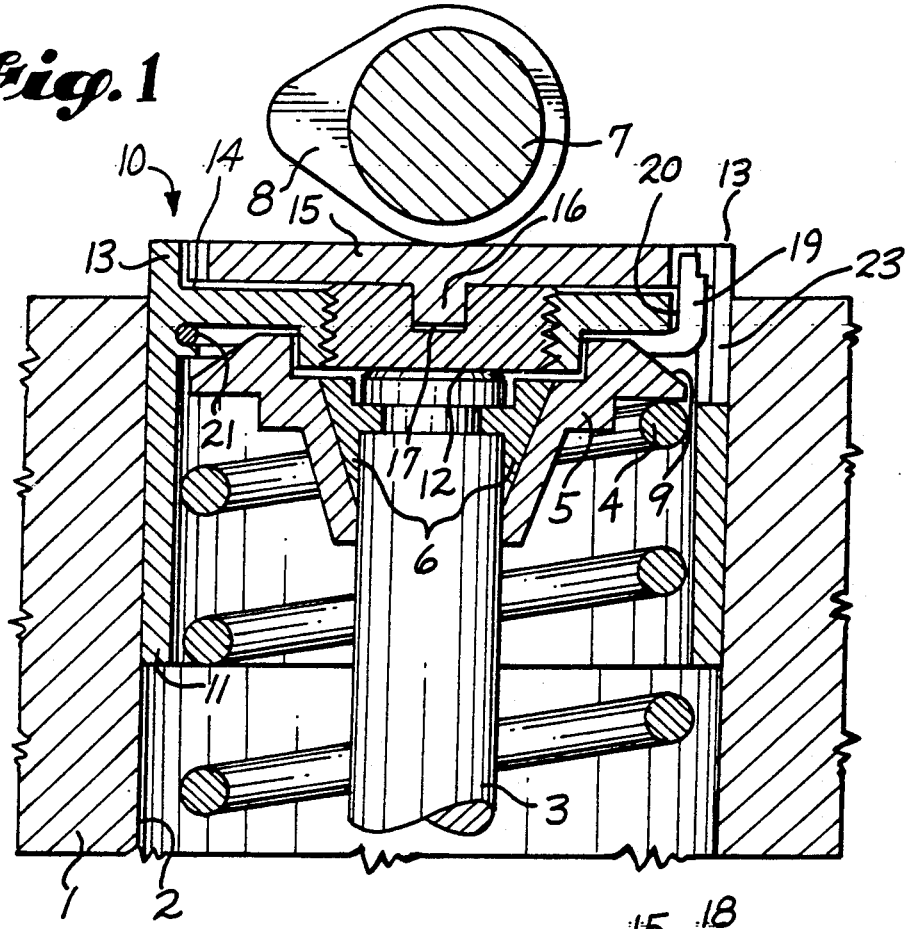
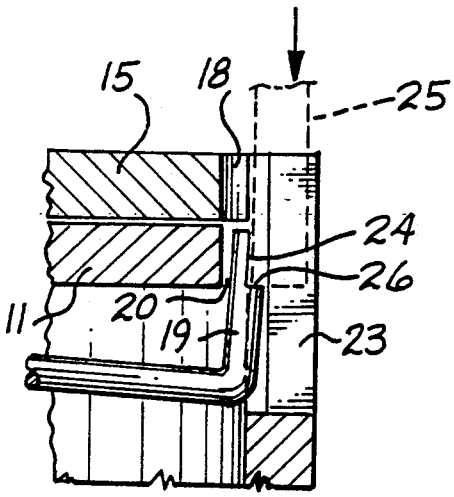
Fig. 4
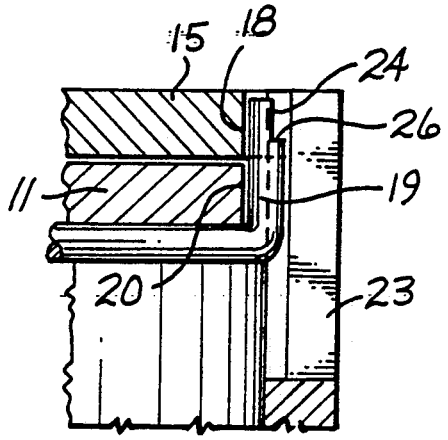
Fig. 3

QUICK ADJUST TAPPET ASSEMBLY

BACKGROUND OF THE INVENTION

1. Field of the Invention

The present invention relates to an improved tappet assembly interposed between an overhead cam shaft and the stem of a standard poppet valve of an internal combustion engine. The effective thickness of such tappet assembly is adjustable to eliminate valve lash without requiring disassembly of the engine.

2. Prior Art

In a conventional overhead cam internal combustion engine, a composite tappet assembly commonly includes an inverted cup follower fitted in a cylindrical bore of the cylinder head in line with the upward-projecting stem of each intake and exhaust valve. Shims can be used to achieve a desired clearance between the top of the valve stem and the follower. The top of the follower is engaged by a lobe of the cam shaft. Ideally, the clearance is set and periodically adjusted so that valve lash is eliminated, i.e., the clearance is zero when the engine reaches its normal operating temperature. It can be timeconsuming, painstaking work to set or adjust the clearance by use of shims.

The construction shown in my earlier U.S. Pat. No. 3,675,631, issued July 11, 1972, is representative of prior attempts to provide adjustable tappet assemblies that eliminate the need for separate shims. In the construction shown in that patent, the inverted cup follower has a threaded central bore receiving a complementally threaded plug for engaging against the top of the valve stem. The top of the plug has a square socket receiving a square tongue of a cap member. Turning the cap member rotates the plug to advance it toward the valve stem or to retract it away from the valve stem.

In my previous construction, the cup follower has a series of "locking holes" concentric with its central bore, and the cap member has a downward-projecting pin normally received in one of such holes so as to prevent rotation of the cap and the plug relative to the cup. In order to adjust the valve clearance, the cap must be wedged upward to free its downward-projecting pin from the locking hole, whereupon the cap can be turned to rotate the plug. When the desired position has been achieved, the cap is lowered for reception of the downward-projecting locking pin into one of the locking holes.

Other known constructions which use relatively rotatable threaded members for adjusting the valve clearance are shown in the following U.S. patents:

U.S. Pat. No. 1,496,497, issued June 3, 1924 (Swarthout et al.);

U.S. Pat. No. 3,002,508, issued Oct. 3, 1961 (Barker et al.);

U.S. Pat. No. 3,301,239, issued Jan. 31, 1967 (Thauer);

U.S. Pat. No. 3,413,964, issued Dec. 3, 1968 (Pask);

U.S. Pat. No. 3,941,102, issued Mar. 2, 1976 (Barham);

U.S. Pat. No. 4,321,894, issued Mar. 30, 1982 (Black).

SUMMARY OF THE INVENTION

The principal object of the present invention is to provide a novel tappet assembly of the general type shown in my U.S. Pat. No. 3,675,631, but in a form which can be more quickly and easily manipulated to effect a desired adjustment of the effective thickness of the assembly, and which allows adjustment in smaller increments, and which is more reliable to maintain a desired adjustment over a long period of use.

In accordance with the present invention, the foregoing object is accomplished by providing a tappet assembly which, similar to the construction shown in my prior U.S. Pat. No. 3,675,631, utilizes an externally threaded plug received in an internally threaded bore of an inverted cup follower for engaging against the upper end of a valve stem and a top cap member interconnected with the plug and turnable relative to the cup. Novel mechanism is providing for normally locking the cap member and threaded plug relative to the inverted cup to maintain a desired adjustment. In the preferred embodiment, the outer periphery of the cap member has uniformly spaced notches. A spring-loaded locking pin carried by the cup is normally received in one of the notches. The pin can be moved to an unlocked position out of registration with the cap member to permit turning of the cap member until a desired adjustment has been achieved, whereupon the pin can be released so as to return automatically to a locked position fitted in one of the peripheral notches of the cap member.

BRIEF DESCRIPTION OF THE DRAWINGS

FIG. 1 is a central vertical section of a quick adjust tappet assembly in accordance with the present invention and adjacent components of an internal combustion engine with parts broken away.

FIG. 3 is a fragmentary enlarged detail section of the tappet assembly of FIGS. 1 and 2 with parts in their locked positions, and FIG. 4 is a fragmentary section corresponding to FIG. 3 with parts in their unlocked positions.

DETAILED DESCRIPTION

Figure 5:
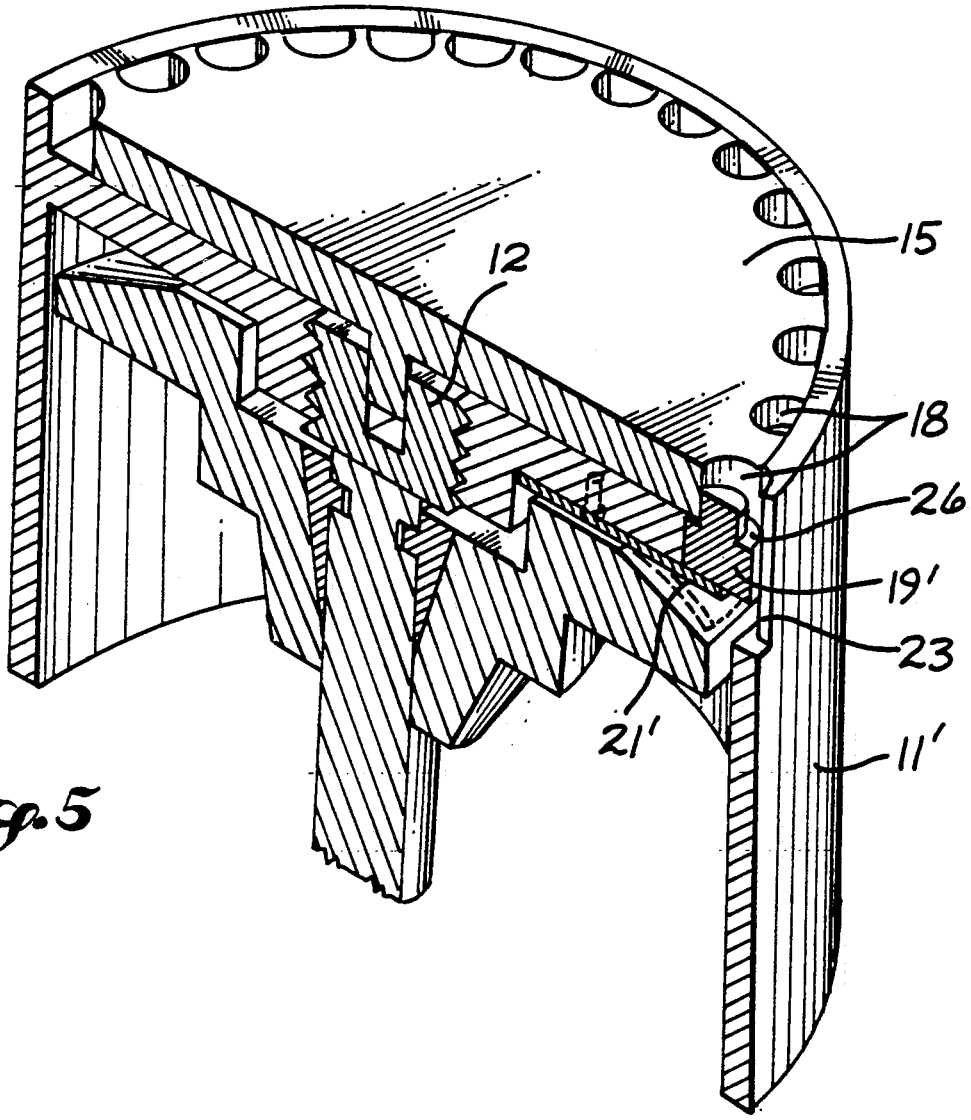
FIG. 5 is a top perspective of a modified quick adjust tappet assembly in accordance with the present invention with parts shown in section.

With reference to FIG. 1, the quick adjust tappet assembly 10 in accordance with the present invention is intended to be used in an otherwise conventional overhead cam internal combustion engine. The conventional components of such engine include the cylinder head 1 having a cylindrical bore 2 in which the valve stem 3 reciprocates. The valve stem is normally biased upward to the position shown in FIG. 1 by a helical compression spring 4 which bears against a retainer 5 held on the valve stem by a conventional split keeper 6. The tappet assembly 10 is interposed between the top end of the valve stem and the conventional cam shaft 7 which has a lobe 8 for forcing the tappet inward to open the valve at the appropriate times.

Figure 2:
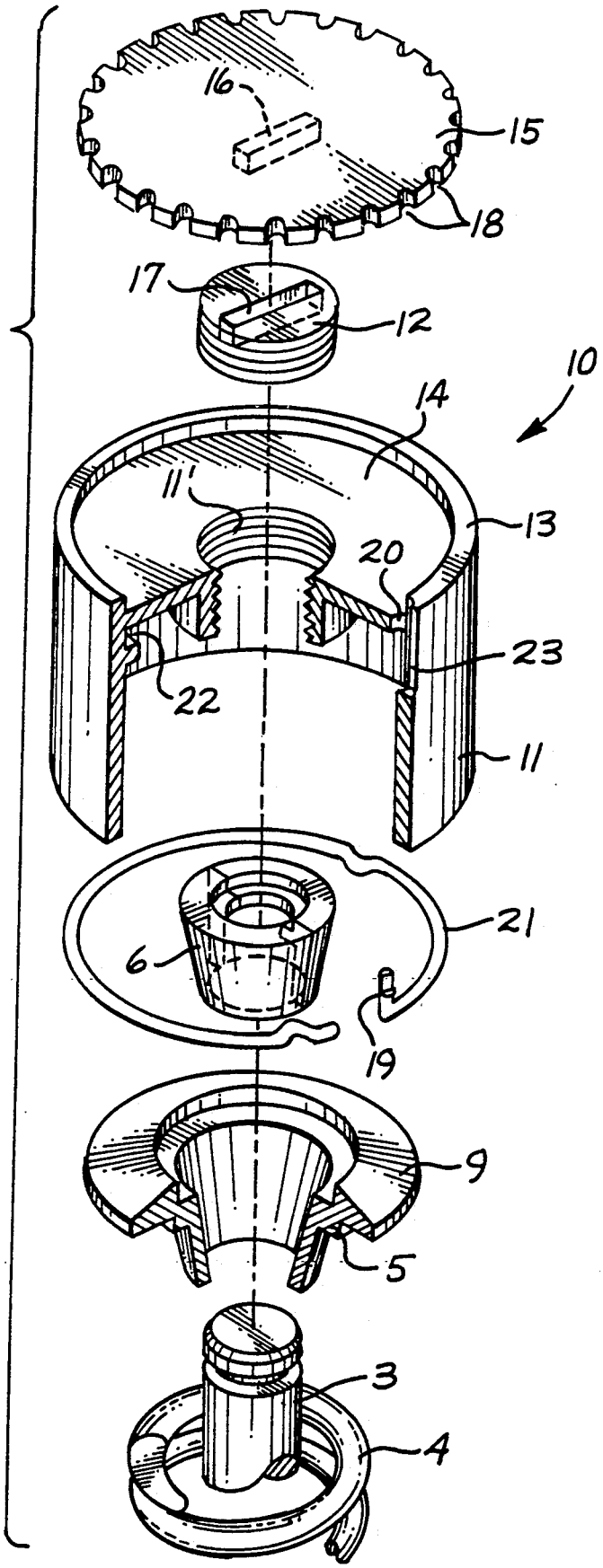
FIG. 2 is a top perspective of the tappet assembly of FIG. 1 with parts shown in exploded relationship.

With reference to FIG. 2, tappet assembly 10 includes an inverted cup follower 11 having a cylindrical outer periphery such that the cup is slidable in the cylinder head. Such cup has an axial through bore 11' internally threaded for receiving a complementally threaded plug 12. The cup member has an upward-projecting rim 13 forming a large central top depression 14. Such depression receives a top disk or cap member 15. The cap member has a rectangular downward-projecting tongue 16 sized to fit closely in a correspondingly shaped upward-opening socket 17 of the plug 12.

With the parts assembled as shown in FIG. 1, the plug 12 and cap member 15 are interconnected by reception of the cap tongue 16 in the plug socket 17. The cap member is accessible from the exterior of the cylinder head 1. Rotation of the cap member in one sense relative to the inverted cup follower 11 advances the plug 12 toward the valve stem 3, whereas turning the cap member in the opposite direction retracts the plug away from the valve stem. Ideally, the position is adjusted such that valve lash is eliminated at normal operating temperatures, i.e., there is no clearance between the top of the valve stem and the underside of the plug with the valve completely closed and the top of the tappet assembly bearing against the circular portion of the cam shaft.

During normal operation of the engine, however, the cap member and plug must be held against rotation so that the desired adjustment is maintained. In the construction shown in my previous U.S. Pat. No. 3,675,631 the floor of the depression 14 of the inverted cup follower was provided with a series of holes, any one of which could receive a locking pin projecting downward from the underside of the cap member. Consequently, in order to achieve rotating adjustment of the cap member, it was necessary to force the inverted cup follower down against the force of the valve spring and at the same time pry the cap member up to free the locking pin from a locking hole. That manipulation required substantial strength, dexterity and experience. In addition, it was found that a surprisingly strong shearing force was applied to the locking pin during normal operation of the engine. If the pin sheared off, the cap member and plug would be free to rotate and the desired adjustment would not be maintained. In an extreme case, the engine could be damaged due to improper adjustment of the valve.

In accordance with the present invention, the locking holes and locking pin of my prior construction are eliminated. Rather, as seen in FIG. 2, the periphery of the cap member 15 has closely spaced semicircular notches 18 opening outward. As seen in FIG. 1, a locking pin 19 normally projects upward above the floor of the central depression 14 of the inverted cup member adjacent to the rim 13 so as to be received in one of the notches. In such position, the locking pin 19 prevents rotation of the cap member 15 and the plug 12 relative to the inverted cup follower.

Preferably, the locking pin 19 extends through a hole 20 through the inverted cup follower and is spring-biased upward to its locking position shown in FIG. 1 and FIG. 3. As seen in FIG. 2, in the preferred embodiment the locking pin 19 is bent perpendicularly upward from the generally circular body 21 of a spring clip. The major portion of such body 21 is received in a groove 22 formed in the inner periphery of the cup follower 11 below the floor of the depression 14. In the orientation shown in FIG. 2, such groove 22 extends counterclockwise from about the hole 20 at least half-way around the cup follower, preferably about three-quarters of the way around (270 degrees), but stops a substantial distance before the other side of the hole. Thus, the section of the spring clip body 21 adjacent to the upward-projecting locking pin 19 is not restrained in the groove and can be moved downward against the natural resiliency of the spring clip tending to bias the locking pin upward.

The upright sidewall of the inverted cup follower 11 has a narrow vertical slot 23 intersecting the locking hole 20. As best seen in FIGS. 3 and 4, the top of the locking pin 19 preferably is notched such that the outer upright side 24 of the locking pin is positioned outward of the periphery of the cap member 15. As illustrated in FIG. 4, a narrow blade 25 can be inserted downward through the slot 23 against the shoulder 26 of the locking pin to force the pin downward sufficiently that it is disengaged from the aligned notch 18 of the cap member 15. With reference to FIG. 1, it is important that the top surface 9 of the spring retainer be beveled downward and outward so as not to interfere with downward movement of the locking pin 19. With the locking pin held in its unlocked position out of registration with the cap member, the cap member can be turned to effect a desired adjustment of the plug 12. When the locking pin is released, it is automatically biased upward to be received in the appropriate peripheral notch of the cap member.

In the modified embodiment shown in FIG. 5, the locking pin 19' is supported at the end of a leaf spring 21' which, in turn, is secured to the underside of the inverted cup follower 11'. Consequently, there is no need for a groove corresponding to the groove 22 of the previously described embodiment. In other respects, the construction of the modified form shown in FIG. 5 is identical to the previously described embodiment. Pin 19' can be moved downward by inserting a small blade in the slot 23 to press against the shoulder 26 of the locking pin. The cap member 15 then can be rotated to effect the desired adjustment of the plug 12. After the desired adjustment has been achieved, the locking pin is released and will be biased upward into the appropriate locking notch 18.

I claim:

1. In a tappet assembly interposed between a valve stem and a cam shaft of an engine and including a follower member having a threaded bore in alignment with the valve stem, a threaded plug member received in such bore, a cap member overlying and interconnected with the plug member such that turning the cap member turns the plug member to move it axially of the valve stem for adjusting the effective thickness of the tappet assembly, such cap member having an outer periphery concentric with such bore, and locking means for normally preventing rotation of the cap member relative to the follower member, the improvement comprising the cap member having an outward-opening peripheral notch, and the locking means including a locking pin nonrotative relative to the follower member and normally received in said notch.

2. In the assembly defined in claim 1, the follower member having a peripheral rim defining a central depression for receiving the cap member therein, the cap member having a multiplicity of closely spaced peripheral notches opening outward toward said rim, the locking pin normally being received in one of said notches and normally being positioned between the cap member and said rim.

3. In the assembly defined in claim 2, the locking pin being carried by the follower member.

4. In the assembly defined in claim 2, the locking pin being movable relative to the cap member and the follower member from its normal position received in one of the peripheral notches to an unlocked position out of registration with the cap member so as to permit rotation of the cap member relative to the follower member.

5. In the assembly defined in claim 4, spring means biasing the locking pin to its normal position.

6. In the assembly defined in claim 5, the spring means including a spring clip mounted on the follower member, said clip having a resilient generally circular body and an end portion bent relative to said body and forming the locking pin.

7. In the assembly defined in claim 4, the spring means including an elongated leaf spring having a first end portion anchored to the follower member and a second end portion carrying the locking pin.

8. In the assembly defined in claim 4, the central depression of the follower member having a floor with a hole therethrough, the locking pin extending through said hole.

9. In the assembly defined in claim 8, the locking pin having an upper end normally spaced above the floor of the depression, the upper end portion of the locking pin being notched and having a shoulder spaced below such upper end and an outer side positioned outward of the periphery of the cap member when the locking pin is in its normal position.

10. In the assembly defined in claim 8, the rim of the follower member having a slot intersecting the hole in the floor of the central depression for access to the locking pin.

* * * * *